US011623263B2

(12) United States Patent
Martin

(10) Patent No.: US 11,623,263 B2
(45) Date of Patent: Apr. 11, 2023

(54) BENDING APPARATUS FOR COILED TUBING

(71) Applicant: Kristian Martin, Prince Rupert (CA)

(72) Inventor: Kristian Martin, Prince Rupert (CA)

( * ) Notice: Subject to any disclaimer, the term of this patent is extended or adjusted under 35 U.S.C. 154(b) by 327 days.

(21) Appl. No.: 17/026,195

(22) Filed: Sep. 19, 2020

(65) Prior Publication Data

US 2021/0086249 A1 Mar. 25, 2021

Related U.S. Application Data

(60) Provisional application No. 62/903,485, filed on Sep. 20, 2019.

(51) Int. Cl.
*E21B 19/22* (2006.01)
*B21D 26/041* (2011.01)

(52) U.S. Cl.
CPC ..... *B21D 26/041* (2013.01); *E21B 19/22* (2013.01)

(58) Field of Classification Search
CPC ..... E21B 19/22
See application file for complete search history.

(56) References Cited

U.S. PATENT DOCUMENTS 4,091,867 A 5/1978 Shannon, Jr. et al.
4,899,823 A 2/1990 Cobb et al.
5,454,419 A 10/1995 Vloedman
5,803,168 A 9/1998 Lormand et al.
6,006,839 A 12/1999 Dearing et al.
6,209,634 B1 4/2001 Avakov et al.
7,165,619 B2 1/2007 Fox et al.
7,810,556 B2 10/2010 Havinga
9,228,395 B2 1/2016 Armstrong et al.
2002/0195255 A1* 12/2002 Reilly ..... E21B 19/24 166/77.2
2004/0118556 A1* 6/2004 Widney ..... E21B 19/22 166/77.1
2006/0283587 A1 12/2006 Wood et al.

FOREIGN PATENT DOCUMENTS

WO 9628633 A2 9/1996
WO 2013095157 A2 6/2013

* cited by examiner

*Primary Examiner* — Giovanna Wright
(74) *Attorney, Agent, or Firm* — Craft Chu PLLC; Andrew W. Chu

(57) ABSTRACT

A bending apparatus for coiled tubing protects the entire path of coiled tubing from the reel to the injector, while still protecting a main controlled bend from the reel to the injector. The bending apparatus includes a conduit having a bend portion and a flexible portion. The main controlled bend is isolated in the bend portion, while a smaller adjustment bend is designed for the flexible portion. The changes in the upright angle from dispensing coiled tubing from different levels of the reel no longer cause damage. The changes in the lateral angle from dispensing coiled tubing from both sides of the reel no longer cause damage. A table mount can also be added to allow more adjustment for changes in the lateral angle.

16 Claims, 7 Drawing Sheets

BENDING APPARATUS FOR COILED TUBING

CROSS-REFERENCE TO RELATED APPLICATIONS

The present application claims priority under 35 U.S.C. Section 119(e) from U.S. Provisional Patent Application Ser. No. 62/903,485, filed on 20 Sep. 2019, entitled "PRESSURE NECK FOR COILED TUBING". See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to oil and gas machinery and devices. In particular, the present invention relates to a coiled tubing equipment. More particularly, the present invention relates to a bending apparatus for inserting coiled tubing into a wellhead.

2. Description of Related Art Including Information Disclosed Under 37 CFR 1.97 and 37 CFR 1.98

Coiled tubing is regular component in well interventions, well drilling, and well completions, that is, well servicing operations, like injecting different fluids into a well. Coiled tubing is long and continuous metal pipe that is stored on large reels and dispensed by turning the reel. The coiled tubing is inserted into a well through a wellhead, usually under pressure. Coiled tubing is important because liquids can be pumped into the coiled tubing without reliance on gravity. No pipe connections are required to deploy the coiled tubing into a well under pressure.

An important issue with coiled tubing is that the metal pipe must be bent several times. The first bending event occurs as the coiled tubing is initially straightened as dispensed from the reel. The coiled tubing is bent the second time as the coiled tubing passes onto the gooseneck or guide arch. Then, the third time when the coiled tubing is bent from the gooseneck to the injector. The coiled tubing is bent the fourth time when the coiled tubing is pulled out of the well and bent back onto the gooseneck. The fifth bend ensues when the coiled tubing is straightened off the gooseneck to be spooled back onto the reel. The straightened coiled tubing bends for the sixth time when winding back onto the reel. Four of the six bends occurs at the gooseneck, with another two bends at the reel.

Prior art patent documents related to bending coiled tubing include U.S. Pat. Nos. 5,279,364, 6,695,048, and USPub20040211555. U.S. Pat. Nos. 6,695,048, 5,454,419, 4,899,823 and US Publication No. 20040211555 also disclose goose neck and other arched guide structures. U.S. Pat. Nos. 6,209,634, 7,165,619, 5,803,168, and 7,810,556 disclose various guide members to protect the coiled tubing from damage during the bending. Kinks and severe angles damage coiled tubing. A notch or other structural defect affects the strength, durability and functionality. A damaged coiled tube cannot protect the pressurized contents within the coiled tubing. A tear or gash will weaken the integrity coiled tubing so that fluids and gases in pressure and temperature conditions cannot be safely maintained. When coiled tubing is bent, the amount of bending is controlled so that there is less risk of damage to the coiled tubing. The prior art guides and arcs form a smooth curve for bending the coiled tubing at a safe curvature. Additionally, guide members of the prior art further protect the coiled tubing for the force exerted to bend. There is no quick large force to sharply bend the coiled tubing into position. The amount of bending and the force exerted to bend are controlled.

As metal pipe, there is a limited amount of bending before the structural integrity of the coiled tubing is lost. With some coiled tubing, within internal tubing pressures of 5000 psi, some computer models estimate 20 cycles (sets of 6 bends) before degradation of the coiled tubing, so coiled tubing is not very re-useable. These 20 cycles apply to the interior of the coiled tubing being pressurized relative to the exterior of the coiled tubing, i.e. the coiled tubing being dispensed in the open air. Some computer models also estimate 130 cycles (sets of 6 bends), if there is no pressure differential between the interior of the coiled tubing and the exterior of the coiled tubing. The pressure differential while bending affects the working life of the coiled tubing.

Pressurized bending is another protection for coiled tubing. U.S. Pat. Nos. 4,091,867 and 6,006,839 disclose pressure equalization during the bending process. The pressure inside the coiled tubing and outside the coiled tubing are equalized to extend the working life of the coiled tubing. Reducing the pressure differential between the inside and outside of the coiled tubing further reduces risk of damaging the coiled tubing during a bending process.

Protections of coiled tubing are limited to the coiled tubing within the bending apparatus. There are gaps in protection coiled tubing between the storage of coiled tubing on a reel or spool and the pressure neck device for bending the coiled tubing and between the pressure neck device for bending and the injector into a wellhead. Although conditions for bending are controlled within the prior art pressure neck devices, there are no protections of coiled tubing until the coiled tubing actually reaches the prior art pressure neck devices. The reel or spool dispenses the coiled tubing so that the coiled tubing may be damaged by sharp bends or kinks, while traveling to and being aligned into the prior art pressure neck devices.

FIG. 1 is a schematic side elevation view of a prior art system 1 of a pressure neck 2 at a wellhead 6. FIG. 1 shows that the upright angle of dispensing from the reel 3 changes as more of the coiled tubing 4 is dispensed to the injector 5. The upright angle of dispensing is constantly changing as the path to the pressure neck device changes. There is a high risk of kink and sharp bend damage 7 to the coiled tubing at the inlet to the pressure neck device as the upright angle changes from the reel 3 at full capacity, middle capacity, and low capacity. Only one level of capacity can be aligned with the prior art pressure neck 2 to reduce the risk of damage.

FIG. 2 is a schematic view of the prior art system 1 of the pressure neck 2 in a top plan view. FIG. 2 shows that the lateral angle of dispensing from the reel 3 changes as more of the coiled tubing 4 is dispensed to the injector 5. FIG. 2 shows that the lateral angle of dispensing from the reel 3 also changes as more coiled tubing in dispensed. The lateral angle of dispensing constantly changes and oscillates back and forth between ends of the reel 3 or spool. There is even more risk of kink and sharp bend damage 8 to the coiled tubing at the inlet to the pressure neck device.

With the rigidity of the prior art pressure neck 2, the kink and sharp bend damage 9 can also occur at a junction between the pressure neck 2 and injector 5 as shown in FIG. 3. The coiled tubing may yank and pull at the outlet of the pressure neck 2, as in FIG. 3, or at the inlet, as in FIGS. 1 and 2.

It is an object of the present invention to provide an apparatus for inserting coiled tubing from a reel or spool and into a well through a wellhead.

It is an object of the present invention to provide an apparatus to protect the coiled tubing between the reel and the bending apparatus.

It is an object of the present invention to provide an apparatus to protect the coiled tubing between the bending apparatus and the injector of the wellhead.

It is an object of the present invention to provide a bending apparatus aligned with an upright angle of dispensing and a lateral angle of dispensing from a reel.

It is another object of the present invention to provide an apparatus with a flexible conduit for bending the coiled tubing from reel to the injector.

It is another object of the present invention to provide an apparatus with a conduit with a distal flexible portion aligning the coiled tubing from the reel to the apparatus.

It is another object of the present invention to provide an apparatus with a conduit with a proximal flexible portion aligning the coiled tubing from the apparatus to the injector.

It is still another object of the present invention to provide an apparatus with an adjustable support frame for the flexible conduit.

It is still another object of the present invention to provide an apparatus to remove the pressure differential from the coiled tubing while bending the coiled tubing in a pressure conduit.

It is an object of the present invention to provide an apparatus to reduce bending stress on the coiled tubing between the reel and the apparatus of the present invention.

It is an object of the present invention to provide a safe and reliable apparatus and method to dispense coiled tubing for bending into a wellhead.

These and other objectives and advantages of the present invention will become apparent from a reading of the attached specification.

BRIEF SUMMARY OF THE INVENTION

Embodiments of the present invention include a bending apparatus for coiled tubing to be inserted into a wellhead by an injector from a reel. The coiled tubing is stored on the reel and is unraveled to be dispensed to the wellhead or raveled to be gathered from the wellhead. The upright angle of the coiled tubing being dispensed from different levels on the reel changes. The lateral angle of the coiled tubing being dispensed from side to side across the reel also changes. Even though prior art devices protect a controlled bend from the reel to the injector, the changing upright angle and lateral angle of the coiled tubing between the reel and the bending apparatus are not protected from damage to the coiled tubing. The bending apparatus of the present invention finally protects the entire path of coiled tubing from the reel to the injector, while still protecting that main controlled bend or critical bend from the reel to the injector.

An embodiment of the bending apparatus includes a conduit and a table mount. The conduit has a proximal end and a distal end, which determine a conduit bend angle of the conduit. The conduit can be bent, and the conduit bend angle is the amount of bend corresponding to the coiled tubing entering the conduit in one direction and exiting the conduit in another direction. The table mount is connected to the proximal end of the conduit. The table mount is comprised of a table plate and a table base. The conduit and the table plate are rotatable together relative to the table base. The table base can be fixed in position to the injector. The table mount accounts for additional changes in lateral angle of the coiled tubing from the reel that cannot be addressed by the conduit.

For the changes in upright angle of the coiled tubing from the reel and for some changes in the lateral angle of the coiled tubing from the reel, the conduit is comprised of a bend portion and a flexible portion. The bend portion has an injector end toward the proximal end and a spool end toward the distal end, which determine a bend angle. The flexible portion has a first flexible end toward the proximal end and a second flexible end toward the distal end, which determine a flexible bend angle. The conduit bend angle is comprised of the bend angle and the flexible bend angle. The main controlled bend is isolated in the bend portion, while a smaller adjustment bend is allowed for the flexible portion. The changes in the upright angle from dispensing coiled tubing from different levels of the reel no longer cause damage because the flexible bend angle can adjust to those changes. The changes in the lateral angle from dispensing coiled tubing from different levels of the reel no longer cause damage because the flexible bend angle can also adjust to those changes. The table mount is supplemental to the conduit so that the table mount of the present invention swivels less than other table mounts.

Embodiments of the present invention include the bend portion between the flexible portion and the proximal end, and the flexible portion between the bend portion and the proximal end. Additionally, the bend portion can avoid the same impingements between distal end and proximal end. The bend portion can be controlled for the same protections against the sharpness of the bend, amount of force to bend, and the rate of bending in order to avoid damage and kinks in the coiled tubing. That is, the bend portion can have impingement sleeves to protect the coiled tubing. The bend portion can also be pressurized to equalize pressure in the interior and exterior of the coiled tubing for less stress on the coiled tubing in the bend portion. The bend portion can also be lubricated for the passing of the coiled tubing.

Additional embodiments of the present invention include the bend portion as rigid or flexible and a conduit with an additional flexible portion so that there are flexible portions at both ends of the bend portion. Some embodiments do not include the table mount, depending upon the amount of flexibility to adjust for the lateral angle of the coiled tubing off the reel.

The present invention also includes a support means for the flexible portion. The support means can include a first support bracket at the first flexible end, and a second support bracket at the second flexible end. There can be support arms between the first support bracket and the second support bracket. The support arms can be telescoping and pivoting for adjusting to changes in position. Although flexible, the flexible portion must still be stable and strong enough to pass the coiled tubing to the critical bend within the bend portion or pass the coiled tubing to the injector after the critical bend.

There are embodiments with the bend portion being flexible; that is, the conduit has a flexible bend portion and a flexible portion so as to be flexible from the proximal end to the distal end. In this embodiment, the flexible portion and the bend portion that is flexible are modular. The conduit bend angle is still comprised of the bend angle and the flexible bend angle, but the bend portion is no longer designated for the critical bend or main controlled bend to the injector, so the flexible bend angle is not restricted to be less than the bend angle. The conduit bend angle is only the net aggregate of the bend angle (which is flexible), and the flexible bend angle (also flexible). It also follows that any bend portion that is flexible may also include a support means for stability.

A related embodiment is the conduit being flexible without being divided into other portions. The conduit is flexible so that the conduit bend angle is variable. The table mount is optional in this embodiment, although the table mount can still account for the changes in the lateral angle of the coiled tubing from the reel. The entire conduit can now account for changes in the upright angle of the coiled tubing from the reel and the lateral angle of the coiled tubing. With the conduit being flexible, additional support is needed to support the position of the distal end relative to the proximal end. The support arms can be connected to different components for the proper positioning of the distal end. Additionally, the entirely flexible conduit may also be pressurized.

DETAILED DESCRIPTION OF THE INVENTION

Figure 1:
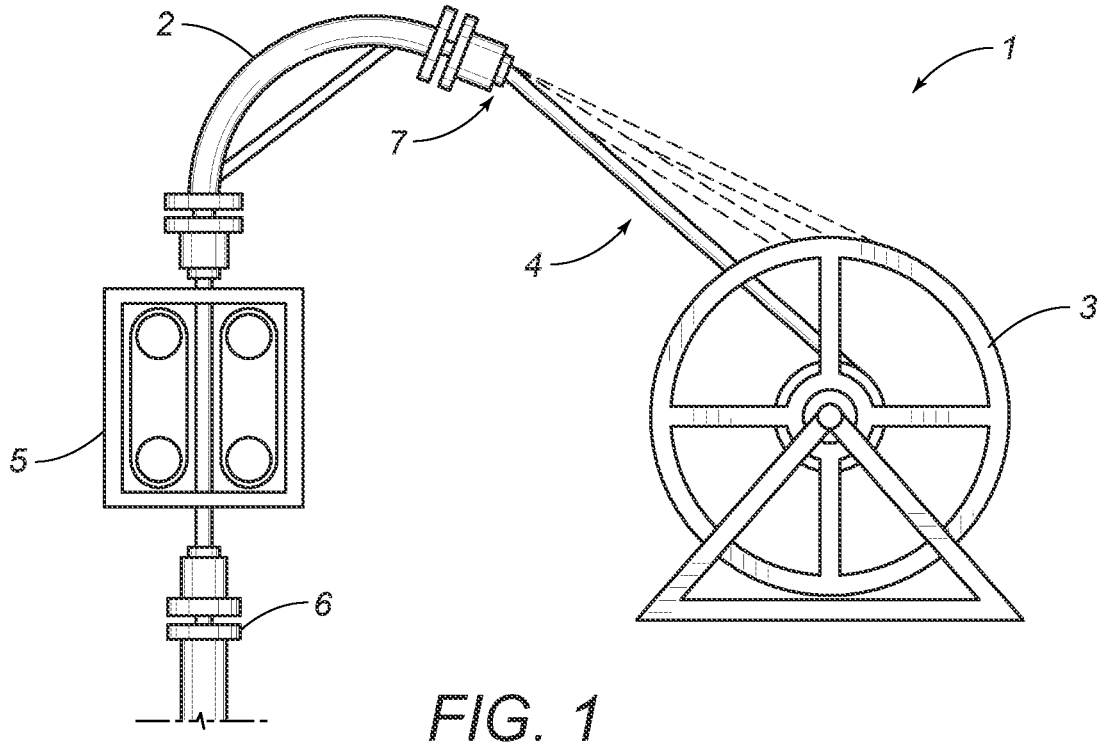
FIG. 1 Prior Art
FIG. 1 is a schematic side elevation view of a prior art system of a pressure neck or guide arc.
Figure 2:
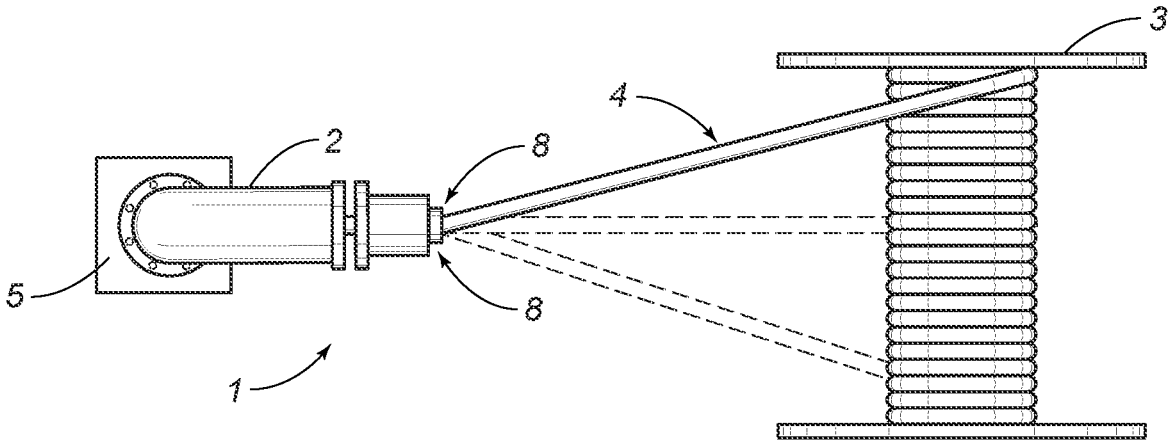
FIG. 2 Prior Art
FIG. 2 is a schematic view of the prior art system of a pressure neck or guide arc in a top plan view.
Figure 3:
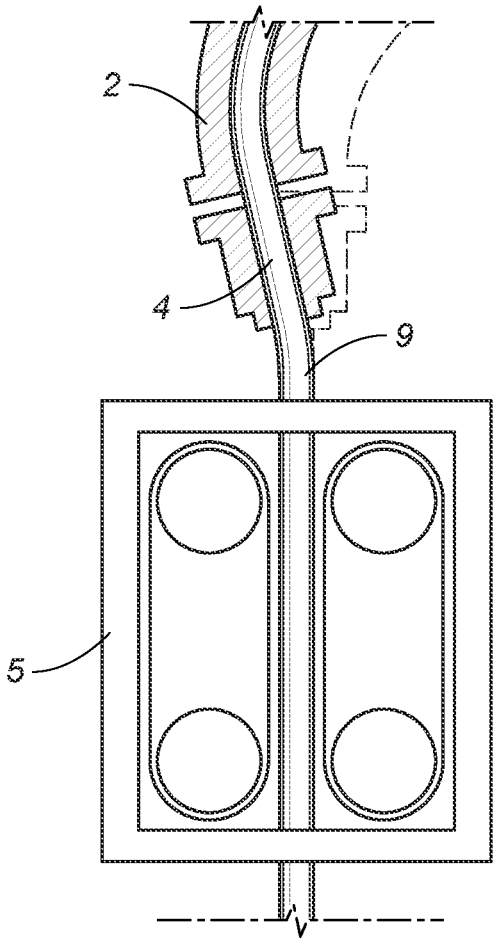
FIG. 3 Prior Art
FIG. 3 is a schematic view of a junction between a prior art pressure neck and injector.

Bending coiled tubing is one step in the process of inserting the coiled tubing into a well through a wellhead. The coiled tubing is already known to be stored on a reel or spool and dispensed from the reel or spool. The coiled tubing is stored in a bent or curved configuration and is unraveled from the reel or spool only to be bent again so as to be aligned with an injector. The injector inserts the coiled tubing through a wellhead, usually under pressure. The protection of the coiled tubing during the step of bending and the devices to perform the bending are known in the prior art. However, there are additional risks for damage separate from the bending. In particular, the path from the reel or spool to the pressure neck and the path from the pressure neck to the injector have high risks for damage, that could render the coiled tubing non-functional or negatively affect the working life of the coiled tubing.

The present invention is a bending apparatus 10 for coiled tubing to protect the entire path of coiled tubing from the reel to the injector, while still protecting the main controlled bend from the reel to the injector. FIGS. 4-12 show embodiments of the bending apparatus 10 comprising a conduit 20 and a table mount 80. The conduit 20 has a proximal end 22 and a distal end 24 opposite the proximal end. The proximal end 22 is positioned relative to the distal end 24 so as to determine a conduit bend angle 26 of the conduit. The conduit 20 is bent, and the conduit bend angle 26 is the amount of bend corresponding to the coiled tubing entering the conduit 20 in one direction and exiting the conduit 20 in another direction, corresponding to the conduit bend angle 26. The proximal end 22 does not face opposite the distal end 24 because of the conduit bend angle 26. The face of the proximal end 22 is angled relative to the face of the distal end 24. The conduit bend angle 26 is the controlled and protected bend to dispense coiled tubing from a reel or spool to an injector of a well head.

The table mount 80 is connected to the proximal end 22 of the conduit 20. The table mount 80 is comprised of a table plate 82 connected to the proximal end 22, and a table base 84 in swiveling engagement to the table plate 82. The conduit 20 and the table plate 82 are rotatable together relative to the table base 84. The table base 84 can be fixed in position to the injector so that the conduit 20 can account for the change in lateral angles of the coiled tubing from the reel. The table base 84 is complementary to the conduit for adjusting to lateral angle changes of the coiled tubing from the reel.

FIGS. 4-12 show embodiments of the conduit 20 comprised of a bend portion 30 and a flexible portion 60. The bend portion 30 has an injector end 32 toward the proximal end 22 and a spool end 34 toward the distal end 24 and opposite the injector end 32. The injector end 32 is positioned relative to the spool end 34 so as to determine a bend angle 36 of the bend portion 30. FIGS. 4-12 further show the conduit 20 being comprised of a flexible portion 60 having a first flexible end 62 toward the proximal end 22 and a second flexible end 64 toward the distal end 24 and opposite the first flexible end 62. The first flexible end 62 is positioned relative to the second flexible end 64 so as to determine a flexible bend angle 66 of the flexible portion 60.

Figure 9:
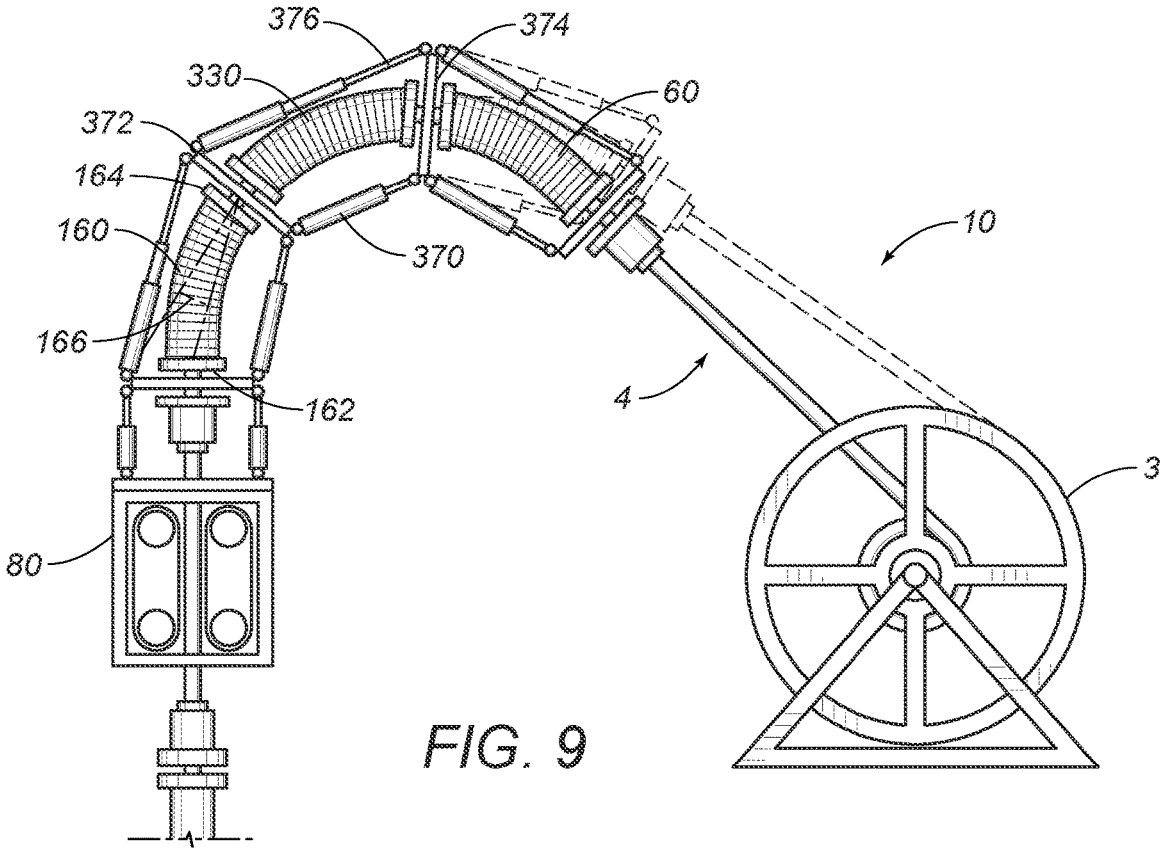
FIG. 9 is a side elevation view of still another embodiment of a bending apparatus for coiled tubing, according to the present invention.
Figure 10:
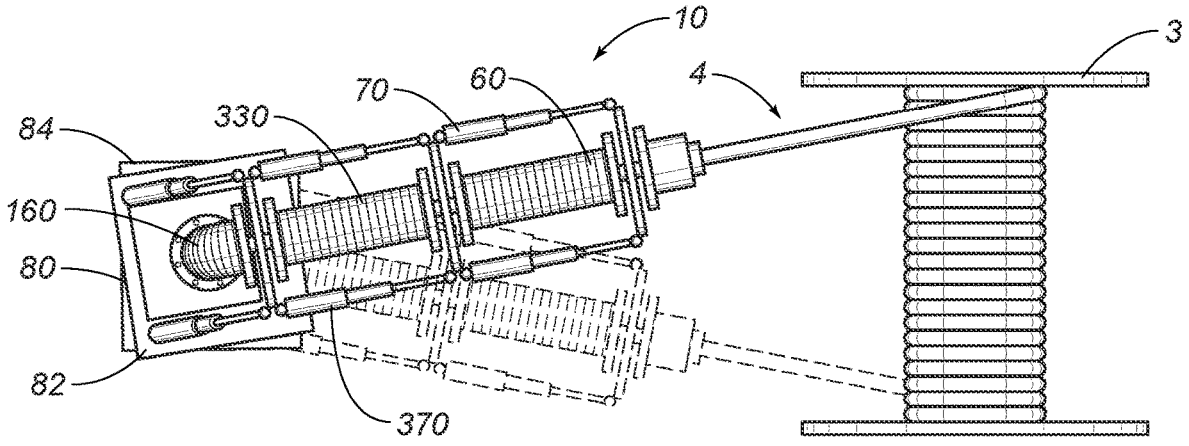
FIG. 10 is a top plan elevation view of the embodiment of FIG. 9 in the wellhead system for coiled tubing, according to the present invention.

FIGS. 4-6, 11 and 12 show an embodiment of the bending apparatus 10 with the bend portion 30 between the flexible portion 60 and the proximal end 22. FIGS. 7-8, 11 and 12 show an embodiment of the bending apparatus 10 with the flexible portion 60 between the bend portion 30 and the proximal end 22. FIGS. 9-10 show an embodiment with an additional flexible portion 160 so that there is a flexible portion 60 at the proximal end 22 and the additional flexible portion 160 at the distal end 24.

The bend angle 36 avoids impingement between distal end 24 and proximal end 22. Analogous to the protection of prior art pressure necks and guides, the bend angle 36 of the bend portion 30 reduces bending stress and avoids kinks in the main controlled bend. The flexible bend angle 66 of the flexible portion 60 also avoids impingement between the distal end 24 and the proximal end 22. The flexible bend angle 66 can also reduce bending stress and avoid kinks in the main controlled bend. The flexible portion 60 just being flexible does not re-introduce the risk of damage from sharp bends and kinks. The flexible portion 60 of the present invention is defined by the flexible bend angle 66 such that the amount of flexibility of the flexible portion 60 is controlled and safe for coiled tubing.

FIGS. 4-8 show the bend portion 30 as rigid, while FIGS. 9-12 show the bending portion 30, 330 as flexible. Embodiments of FIGS. 4-8 show the bend portion 30 being rigid. The bend angle 36 can be constant. The injector end 32 and the spool end 34 are stably located. FIGS. 9-12 show embodiments of the bend portion 30 being flexible.

In particular for FIGS. 9-10 with the additional flexible portion 160, the bend portion 30 is between flexible portion 60 and the additional flexible portion 160. FIGS. 9-10 further indicate that the bend portion 330 is also flexible. The bend angle is variable. The injector end 332 and the spool end 334 can move relative to each other.

All embodiments of the bending apparatus 10 in FIGS. 4-12 show that the conduit bend angle 26 is comprised of the bend angle 36 and the flexible bend angle 66. In FIGS. 4-8, the flexible bend angle 66 is less than the bend angle 36. The bend angle 36 of the bend portion 30 is responsible for most of the bending from the reel or spool to the injector. The bend portion 30 can be controlled for the same protections against the sharpness of the bend, amount of force to bend, and the rate of bending in order to avoid damage and kinks in the coiled tubing. The flexible portion 60 accounts for finer adjustments due to upright angle and lateral angle of the coiled tubing from the reel or spool. The table mount is supplemental to the adjustments for lateral angle. FIGS. 4-8 separate the critical bend to the injector in the bend portion 30 and the minor bends in the flexible portion 60 related to the adjustments needed due to the mechanics of raveling and unraveling from the reel.

Embodiments of the apparatus 10 include means 50 for passage in and out the conduit 20. FIGS. 4-12 show the means 50 for passage including a proximal stripper 52 removably attached to the proximal end 22 and a distal stripper 54 removably attached to the distal end 24. Other embodiments include a proximal flange bracket 56 at the proximal end 22 and a distal flange bracket 58 at the distal end 24 to stabilize the proximal end 22 and the distal end 24 with these components, i.e., the proximal stripper 52, the distal stripper 54, the proximal flange bracket 56, and the distal flange bracket 58. The alignment and stability of the coiled tubing at the proximal end 22 is important so that the coiled tubing is inserted safely into the injector. Being under pressure and interfacing with the wellhead at this juncture requires stability, support, and a low risk of damage to the coiled tubing.

Figure 13:
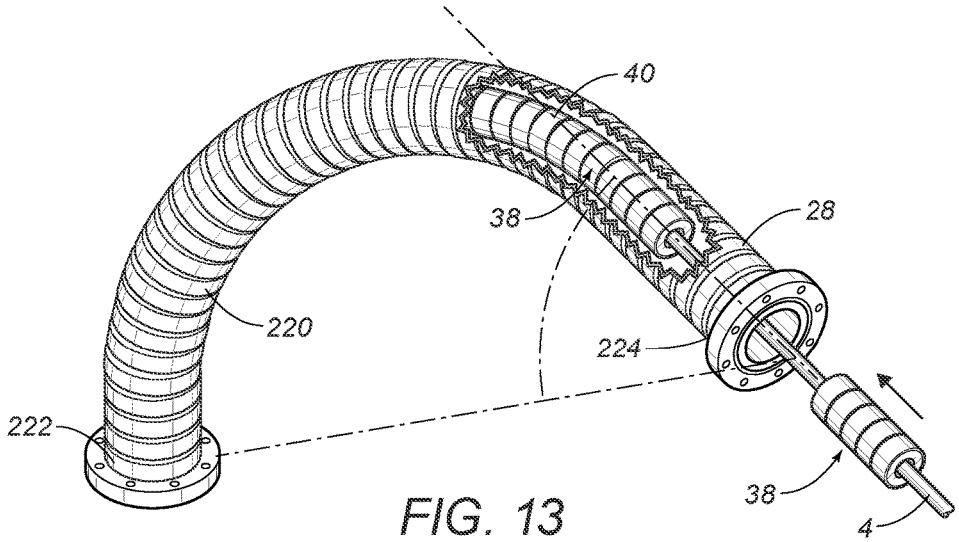
FIG. 13 is a partially exploded perspective view of a flexible portion or flexible conduit of the bending apparatus, according to the present invention.
Figure 14:
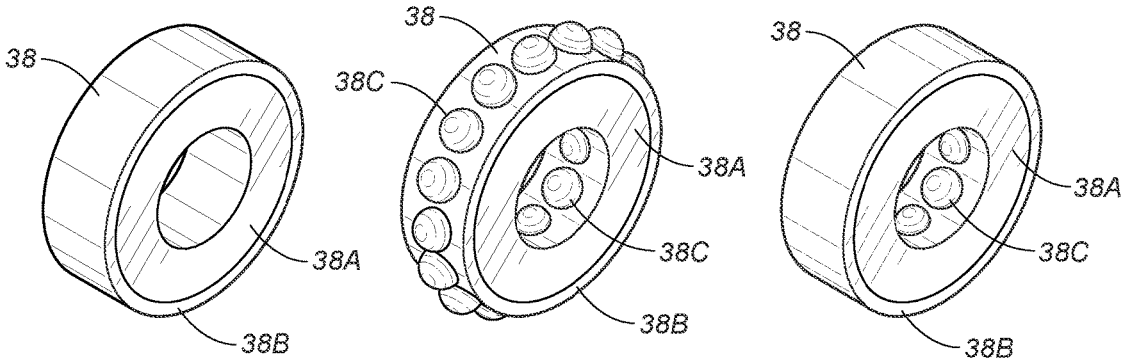
FIG. 14 are perspective schematic views of impingement sleeves for the flexible portion or flexible conduit of the bending apparatus, according to the present invention.

In some embodiments, the bend portion 30 can be comprised of a plurality of impingement sleeves 38 concentrically aligned with each other from the proximal end 22 to the distal end 24 as shown in FIGS. 13-14. Each impingement sleeve 38 has an inner surface and an outer surface. Each impingement sleeve can be comprised of a core 38A forming the inner surface, shielding 38B around the resin core, and a plurality of bearings 38C on the inner surface, the outer surface or both. The core 38A can be comprised of a suitable self-lubricating plastic, such as a polymer resin like polytetrafluorene or perfluoroalkoxy. The shielding 38B protects the core 38A from wear and from damaging the conduit 20. FIG. 14 shows the bearings 38C can be either an inner surface or an outer surface or both. These impingement sleeves 38 protect the coiled tubing in the main controlled bend or critical bend to the injector. The amount of bend and the amount of force to bend are controlled by the impingement sleeves 38 to lower the risk of damage to the coiled tubing.

Figure 4:
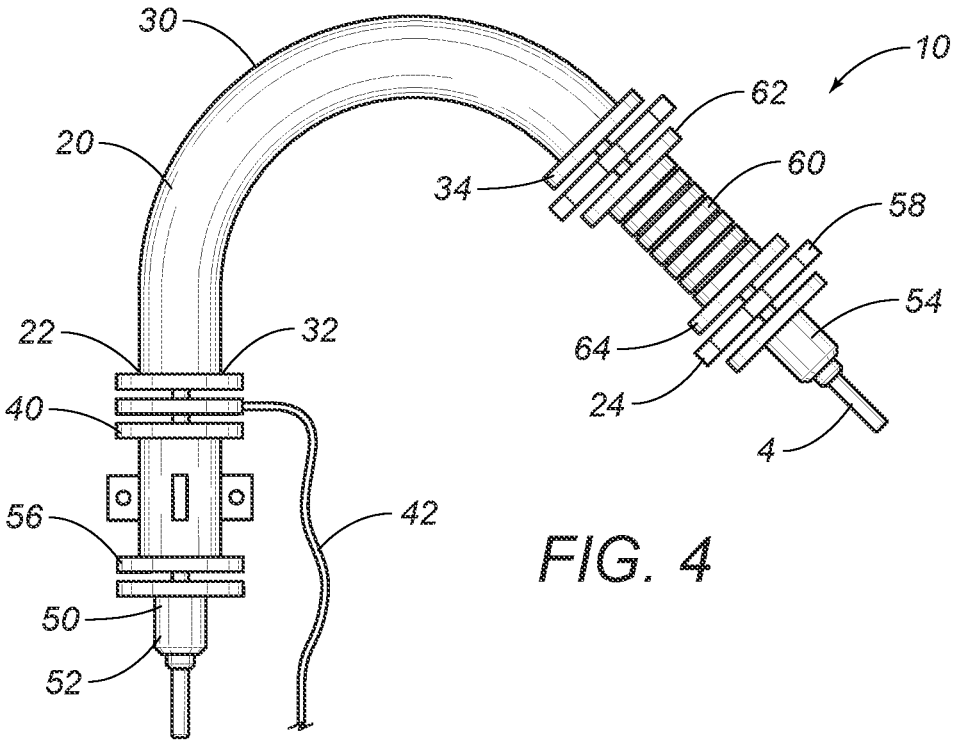
FIG. 4 is a side elevation view of an embodiment of a bending apparatus for coiled tubing, according to the present invention.
Figure 5:
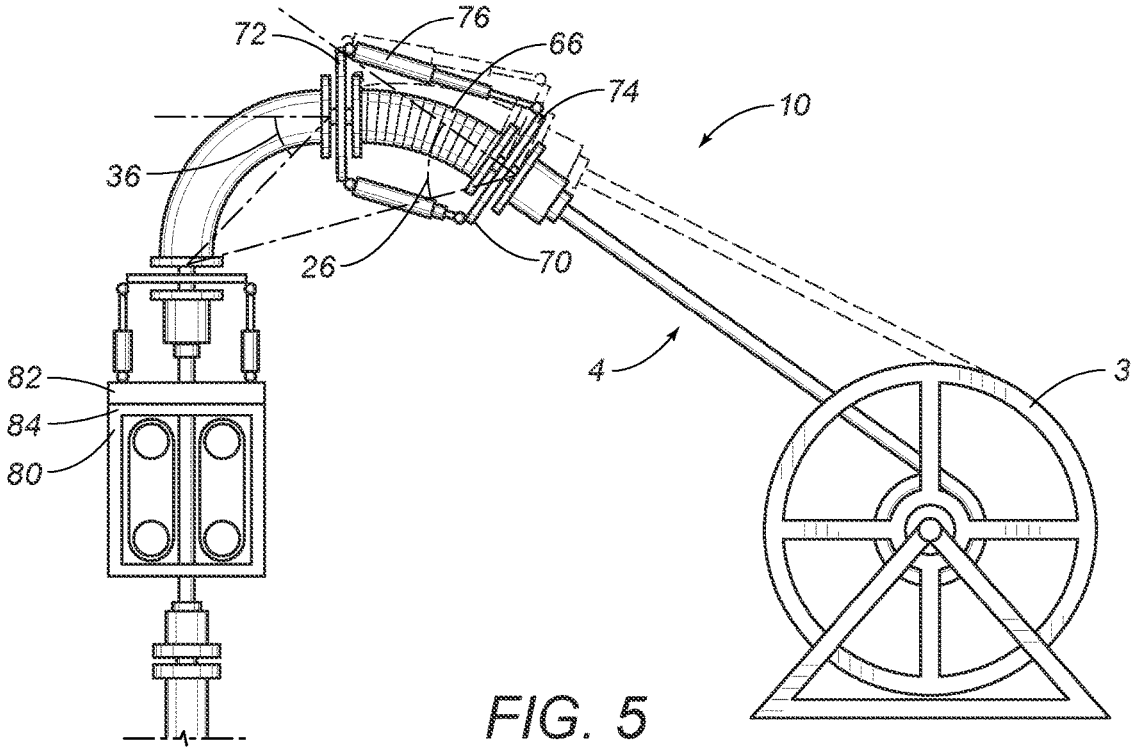
FIG. 5 is a side elevation view of the embodiment of FIG. 4 in a wellhead system for coiled tubing, according to the present invention.
Figure 6:
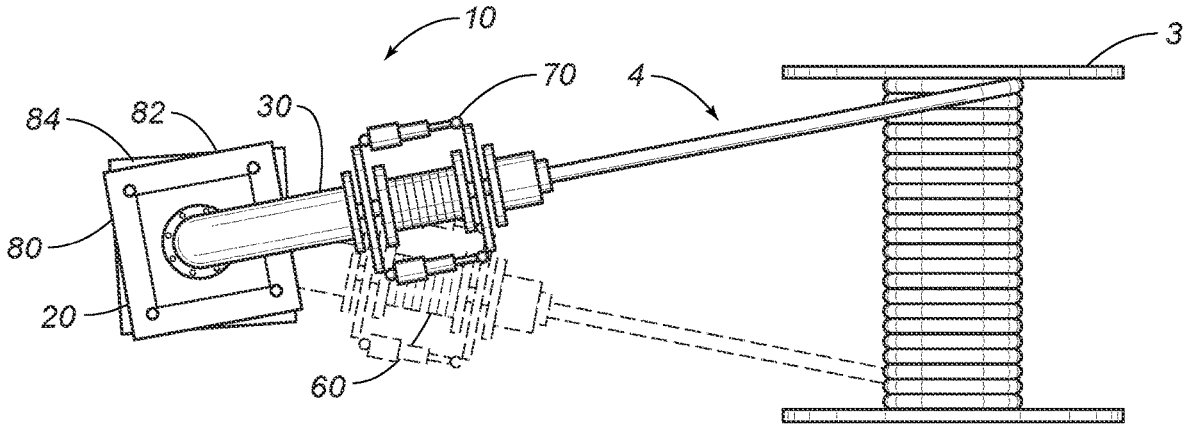
FIG. 6 is a top plan elevation view of the embodiment of FIG. 4 in the wellhead system for coiled tubing, according to the present invention.
Figure 11:
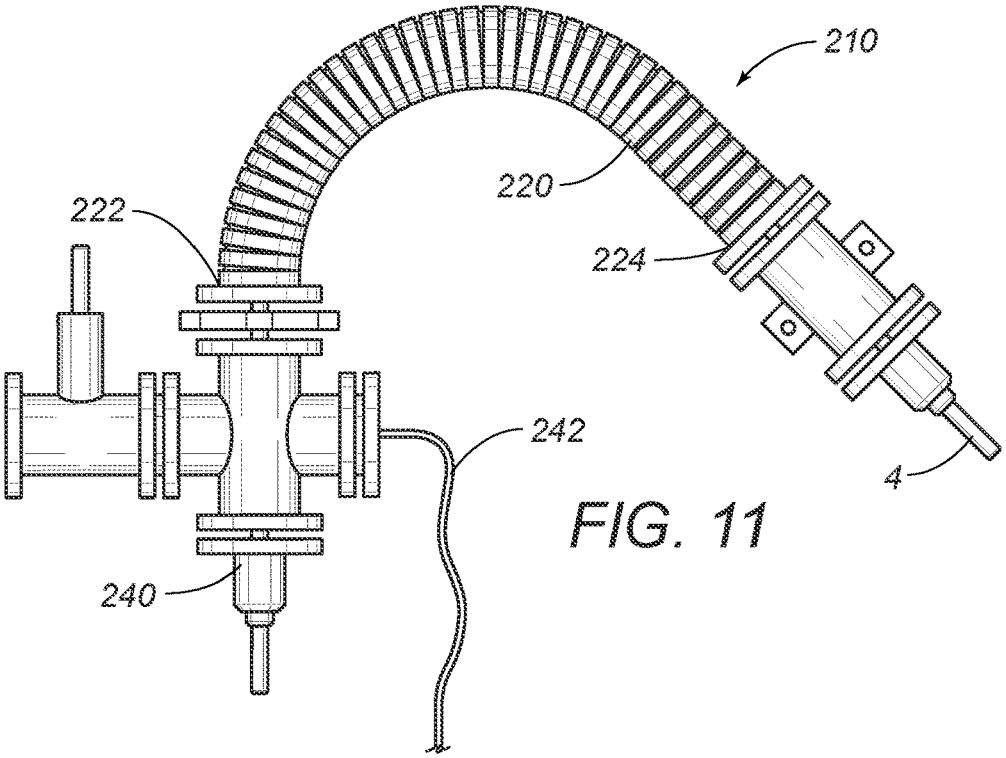
FIG. 11 is a side elevation view of yet another embodiment of a bending apparatus for coiled tubing, according to the present invention.
Figure 12:
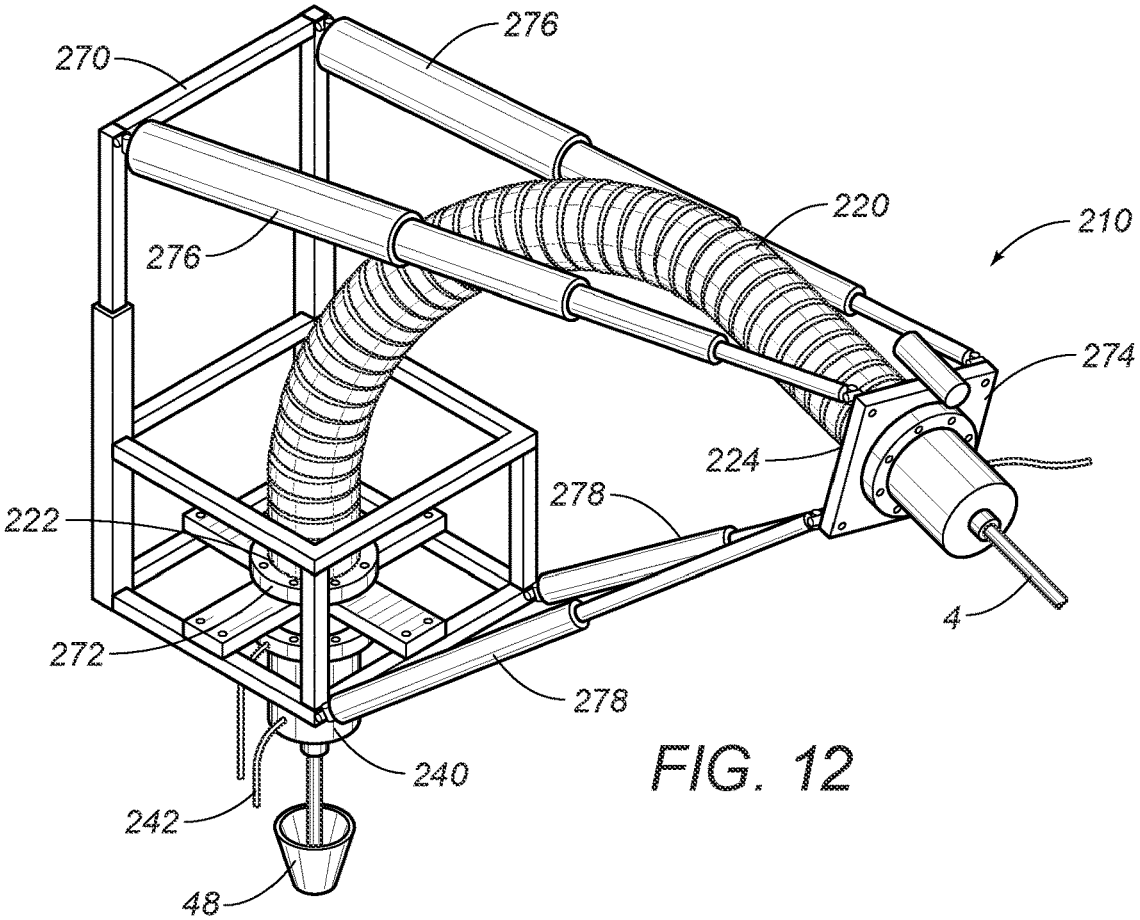
FIG. 12 is a perspective view of the embodiment of FIG. 11 with supports, according to the present invention.

In the embodiments of FIGS. 4, 11 and 12, the bend portion can also be pressurized. The pressure equalization of the interior of the coiled tubing and the exterior of the coiled tubing, while the coiled tubing passes through the bend portion increases the working life of coiled tubing. The pressure control on both the interior and exterior of the coiled tubing reduces stress of the bend. FIGS. 4, 11 and 12 show means 40 for pressurizing the bend portion 30 from the injector end 32 to the spool end 34. The means 40 for pressurizing includes a pressure hose 42 in fluid connection with the bend portion 30 at the injector end 32. The pressure hose 42 can regulate the pressure within the bend portion 30. The means 40 for pressurizing can include other components, such as pumps, seals, valves, O-rings, a bleed ring 44 and bleed hose 46 to control pressure, including releasing excess pressure from the bend portion 30. Again, the main controlled bend or critical bend to the injector is protected in the bend portion 30.

The bend portion 30 in FIGS. 4-8 can include impingement sleeves 38. Impingement sleeves 38 are not limited to only the bend portion 30. It may also be possible to use impingement sleeves 38 in the flexible portion 60 (see FIG. 13). In the alternate embodiment of FIGS. 11-12, impingement sleeves 38 can be used in the entire conduit 220. These protections from damage caused by sharp bends and kinks in the flexible portion 60 or conduit 220 are alternate embodiments from the bending apparatus 10 in FIGS. 4-8.

The embodiment of FIG. 12 shows another embodiment for the bend portion 30 being lubricated. A lubricant within the conduit reduces friction and allows coiled tubing to pass more easily through the conduit. FIG. 12 shows a containment vessel 48 to capture lubricant that may pass through the proximal stripper 52. The containment vessel 48 with a lubricant, such as grease or other compound, can improve movement through the conduit 20 without interfering with the injector.

Figure 7:
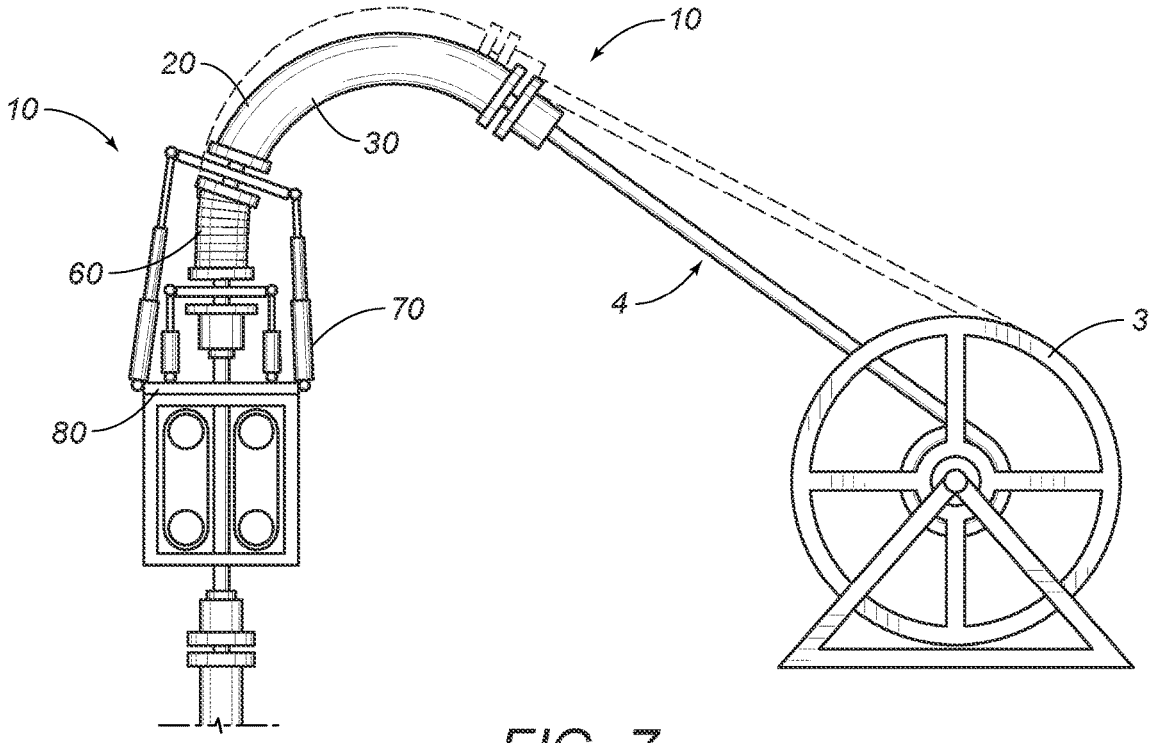
FIG. 7 is a side elevation view of another embodiment of a bending apparatus for coiled tubing, according to the present invention.
Figure 8:
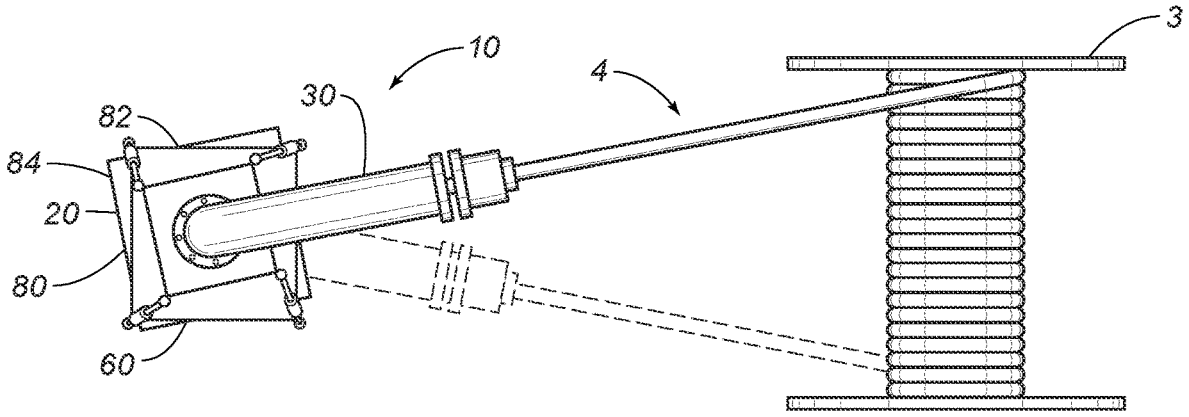
FIG. 8 is a top plan elevation view of the embodiment of FIG. 7 in the wellhead system for coiled tubing, according to the present invention.

Embodiments of the flexible portion 60 further include being comprised of a support means 70 as in FIGS. 5-10 and 12. The support means 70 includes a first support bracket 74 at the first flexible end 64, a second support bracket 72 at the second flexible end 62, and a plurality of support arms 76. Each support arm 76 can be connected to the first support bracket 74 and the second support bracket 72. The support arms 76 hold position of the first flexible end 64 relative to the second flexible end 62. The support arms 76 can be telescoping and pivoting for adjusting to changes in position. Although flexible for adjustments due to variations in the upright angle and the lateral angle from the reel, the flexible portion 60 can be stabilized to allow for the coiled tubing to pass through any of the variations in the uprights angle or lateral angle or both. The table mount is no longer required with the distal end has the range to account for the lateral angle changes of the coiled tubing from the reel. FIGS. 5-8 show the support means 70 in any order of the bending portion 30 and the flexible portion 60. FIG. 7 show an alternate embodiment for when the flexible portion 60 is between the bend portion 30 and the proximal end 22. In that embodiment, the support arms 76 connect the first support bracket 74 and the table plate 82, instead of the first support bracket 74 to the second support bracket 72. The support arms 76 can anchor to the table mount 80 in this embodiment.

FIGS. 9-10 show an alternate embodiment of the invention with an additional flexible portion 160. The bend portion 30, 330 is between the flexible portion 60 and the proximal end 22 and the additional flexible portion 160 is between the bend portion 30 and the proximal end 24. The flexible portions 60, 160 can be modular. The additional flexible portion 160 has an additional first flexible end 162 toward the proximal end 22 and an additional second flexible end 164 toward the distal end 24 and opposite the additional first flexible end 162. The additional first flexible end 162 is also positioned relative to the additional second flexible end 164 so as to determine an additional flexible bend angle 166 of the additional flexible portion 160. The conduit bend angle 26 is now comprised of the bend angle 36 and the flexible bend angle 66 and the additional bend angle 166. When the bend portion 30 is rigid, like FIGS. 4-8, the additional flexible bend angle 166 is less than the bend angle 36.

When the bend portion is also flexible, as shown in FIGS. 9-10 (and FIGS. 11-12), the bend angle 36 and the flexible bend angle 66 (and the additional flexible bend angle 166) can have less restriction. The bend portion 30, 330 is no longer designated for the critical bend or main controlled bend to the injector, so the flexible bend angle 66 and the additional flexible bend angle 166 are not restricted to be less than the bend angle 36. The conduit bend angle is only the net aggregate of the bend angle (which is flexible), and the flexible bend angle (also flexible). The additional flexible bend angle is also flexible as well.

FIGS. 9-10 further show another consequence of the bending portion 30, 330 being flexible, instead of rigid and the bend angle 36 being variable, instead of constant. The bending portion 30, 330 now needs support to hold the position of the spool end 34 relative to the injector end 32. In this alternate embodiment, the apparatus 10 is further comprised of a bend support means 370. The bend support means 370 is comprised of a first bend support bracket 372 at the injector end 32, a second bend support bracket 374 at the spool end 34, and a plurality of support arms 376. Each support arm 376 connects to the first bend support bracket 374 and the second bend support bracket 372. The support arms 376 hold position of the spool end 34 relative to the injector end 32 at the bend angle 36. Although FIGS. 9-10 show the modular version with the additional flexible portion 160, a bend support means is also compatible with only one flexible portion and in any sequence of the flexible portion and bend portion.

Another alternate embodiment of the invention is shown in FIGS. 11-12. Similar to FIGS. 9-10 with the bend portion being flexible and the flexible portion being flexible, the invention can be re-stated as the entire conduit 20 being flexible. FIGS. 11-12 show this restatement. The bending apparatus 210 for coiled tubing comprises a conduit 220 and a support means 270. The conduit 220 has a proximal end 222 and a distal end 224 opposite the proximal end 222. The proximal end 222 is positioned relative to the distal end 224 so as to determine a conduit bend angle 226 of the conduit 20. The conduit 220 is flexible so that the conduit bend angle 226 is variable. The table mount is optionally connected to the proximal end 222 of the conduit 220 (not shown). The optional table mount may also be comprised of a table base connected to the injector, and a table plate in swiveling engagement to the table base. The conduit 220 and the table plate are rotatable together relative to the table base. The table mount is option because the distal end 224 can be adjusted for the upright angle of coiled tubing from the reel and the lateral angle back and forth along the reel. The support means 270 can adjust in more than one dimension to account for both upright angle and lateral angle adjustments.

With the conduit 220 being flexible, support is needed to support the position of the distal end 224 relative to the proximal end 222. The support means 270 can be comprised of a first support bracket 272 at the proximal end 222 and a second support bracket 274 at the distal end 224. The second support bracket 274 can be attached to other structures to hold position of the distal end 224 for alignment with the coiled tubing from the reel. The other structures, such as braces and support arms 276 (FIG. 12), may be adjustable for the different upright angle and lateral angle of the coiled tubing from the reel. The first support bracket 272 is also attachable to other structures, such as a frame connected to the injector (FIG. 12).

FIG. 12 shows the particular embodiment of the support means 270 being further comprised of a first plurality of support arms 276 connected above the second support bracket 274 and to a top side of the second support bracket 274, and a second plurality of support arms 278 connected below the second support bracket 274 and to a bottom side of the second support bracket 274. The support arms 276, 278 hold position of the distal end 224 relative to the proximal end 222 at the conduit bend angle 226. The conduit bend angle 226 can still safely dispense coiled tubing from a spool to an injector of a well head. The support arms 276, 278 are telescoping and pivotable to adjust length and direct as the distal end 224 adjusts to the change in upright angle and lateral angle of the coiled tubing from the reel or spool.

The alternate embodiment can also the conduit 220 being pressurized. There is a means 240 for pressurizing the conduit 220 from the distal end 224 to the proximal end 222. The means 240 for pressurizing includes a pressure hose 242 in fluid connection with the conduit at the proximal end 222. The pressure hose 242 can regulate the pressure within the conduit 220. Other components of the means 240 for pressurizing include pumps, seal, valves, and other known components. The alternate embodiments also include the conduit 220 being lubricated with a collection vessel 48 to remove lubricant as the coiled tube passes through the conduit 220 in both directions.

The present invention provides a bending apparatus for inserting coiled tubing from a reel or spool and into a well through a wellhead. The bending apparatus protects the coiled tubing between the reel and the bending apparatus and between the bending apparatus and the injector of the wellhead. Between the reel and the bending apparatus, the upright angle of dispensing from the reel changes as coiled tubing is unraveled and raveled. The lateral angle of dispensing from a reel oscillates back and forth across the reel as coiled tubing is unraveled and raveled. The bending apparatus of the present invention includes a flexible portion to account for these changing angles, which prevents damage, such as tears, strains, and kinks. A table mount can provide a swiveling engagement to make additional adjustments for the changes in the lateral angle. In the present invention, the amount of swiveling can be reduced relative to the prior art. The present invention can fit more locations and require less movement.

There is also a bend portion for safely and reliably bending the coiled tubing into the injector. The bend portion can have the same protections for the amount of bending, the rate of bending, and the force used to bend. The critical bend or main controlled bend can be isolated to the bend portion. The bend portion can also be pressurized for the equalization of the interior and exterior of the coiled tubing during bending.

In some embodiments, the flexible portion can have less bend than the bend portion. The flexible portion is fine tuning of the alignment of the coiled tubing so that there are no tears, strains or kinks as the coiled tubing enters or exits the conduit. The flexible portion at the distal end of the conduit can adjust before the coiled tubing enters the bend portion. The flexible portion can also be at the proximal end to adjust after the coiled tubing exits the bend portion. The present invention further includes an adjustable support frame for the flexible portion. The flexible portion can adjust, but the flexible portion must also be sufficiently stable to remain aligned with the conduit.

In other embodiments, there is an additional flexible portion. There can be flexible portions to adjust at both the distal end and the proximal end.

There can also be a flexible bend portion. The critical bend can still be isolated to a flexible bend portion. Components, such as impingement sleeves, can still limit the flexibility so as prevent damage to the coiled tubing. Thus, the conduit can have a flexible bend portion and a flexible portion or be flexible from the distal end to the proximal end. These embodiments are still adjustable for the upright angle and lateral angle of dispensing the coiled tubing from a reel or spool, and these embodiments still require a support system for the flexible portion or flexible conduit.

The foregoing disclosure and description of the invention is illustrative and explanatory thereof. Various changes in the details of the illustrated structures, construction and method can be made without departing from the true spirit of the invention.

I claim:

1. A bending apparatus for coiled tubing, said apparatus comprising:

a conduit having a proximal end and a distal end opposite said proximal end, wherein said proximal end is positioned relative to said distal end so as to determine a conduit bend angle of said conduit, wherein said conduit is comprised of:

a bend portion having an injector end toward said proximal end and a spool end toward said distal end opposite said spool end, wherein said injector end is positioned relative to said spool end so as to determine a bend angle of said bend portion; and a flexible portion having a first flexible end toward said proximal end and a second flexible end toward said distal end and opposite said first flexible end, wherein said first flexible end is positioned relative to said second flexible end so as to determine a flexible bend angle of said flexible portion, wherein said conduit bend angle is comprised of said bend angle and said flexible bend angle, and wherein said flexible bend angle is less than said bend angle; and a table mount connected to said proximal end of said conduit, said table mount being comprised of a table plate at the proximal end; and a table base in swiveling engagement to said table plate, said conduit and said table plate being rotatable together relative to said table base.

2. The bending apparatus, according to claim 1, wherein said bend portion is between said flexible portion and said proximal end.

3. The bending apparatus, according to claim 1, wherein said flexible portion is between said bend portion and said proximal end.

4. The bending apparatus, according to claim 3, wherein said flexible portion is comprised of a support means, and wherein said support means is comprised of a first support bracket at said first flexible end, and a second support bracket at said second flexible end, and a plurality of support arms, each support arm being connected to said first support bracket and said table plate.

5. The bending apparatus, according to claim 1, wherein said bend portion is rigid, said bend angle being constant.

6. The bending apparatus, according to claim 1, wherein said bend portion is flexible, said bend angle being variable.

7. The bending apparatus, according to claim 1, further comprising:

a proximal flange bracket at said proximal end; and a distal flange bracket at said distal end.

8. The bending apparatus, according to claim 1, wherein said bend portion is comprised of a plurality of impingement sleeves concentrically aligned with each other from said injector end to said spool end.

9. The bending apparatus, according to claim 8, wherein each impingement sleeve has an inner surface and an outer surface, and wherein each impingement sleeve is comprised of a core forming said inner surface, a shielding around said core, and a plurality of bearings on said inner surface, said outer surface or both.

10. The bending apparatus, according to claim 1, wherein said bend portion is lubricated, further comprising: a containment vessel at said proximal end.

11. The bending apparatus, according to claim 1, wherein said bend portion is pressurized.

12. The bending apparatus, according to claim 11, further comprising:

means for pressurizing said bend portion from said injector end to said spool end, wherein the means for pressurizing comprises a pressure hose in fluid connection with said bend portion at said injector end.

13. The bending apparatus, according to claim 1, wherein said flexible portion is comprised of a support means, and wherein said support means is comprised of a first support bracket at said first flexible end, and a second support bracket at said second flexible end, and a plurality of support arms, each support arm being connected to said first support bracket and said second support bracket.

14. The bending apparatus, according to claim 1, further comprising an additional flexible portion, wherein said bend portion is between said flexible portion and said proximal end and said additional flexible portion is between said bend portion and said proximal end, wherein said additional flexible portion has an additional first flexible end toward said proximal end and an additional second flexible end toward said distal end and opposite said additional first flexible end, wherein said additional second flexible end is positioned relative to said additional first flexible end so as to determine an additional flexible bend angle of said additional flexible portion, wherein said conduit bend angle is comprised of said bend angle and said flexible bend angle and said additional bend angle, and wherein said additional flexible bend angle is less than said bend angle.

15. A bending apparatus for coiled tubing, the apparatus comprising:

a conduit having a proximal end and a distal end opposite said proximal end, wherein said proximal end is positioned relative to said distal end so as to determine a conduit bend angle of said conduit, wherein said conduit is comprised of:

a bend portion having an injector end toward said proximal end and a spool end toward said distal end opposite said spool end, wherein said injector end is positioned relative to said spool end so as to determine a bend angle of said bend portion; and a flexible portion having a first flexible end toward said proximal end and a second flexible end toward said distal end and opposite said first flexible end, wherein said second flexible end is positioned relative to said first flexible end so as to determine a flexible bend angle of said flexible portion, and wherein said conduit bend angle is comprised of said bend angle and said flexible bend angle;

a bend support means, wherein said bend support means is comprised of a first bend support bracket at said injector end, a second bend support bracket at said spool end, and a plurality of support arms, each support arm is connected to said first bend support bracket and said second bend support bracket; and an additional flexible portion, wherein said bend portion is between said flexible portion and said proximal end and said additional flexible portion is between said bend portion and said proximal end, wherein said additional flexible portion has an additional first flexible end toward said proximal end and an additional second flexible end toward said distal end and opposite said additional first flexible end, wherein said additional first flexible end is positioned relative to said additional second flexible end so as to determine an additional flexible bend angle of said additional flexible portion, and wherein said conduit bend angle is comprised of said bend angle and said flexible bend angle and said additional bend angle.

16. A bending apparatus for coiled tubing, the apparatus comprising:

a conduit having a proximal end, and a distal end opposite said proximal end, wherein said proximal end is positioned relative to said distal end so as to determine a conduit bend angle of said conduit, and wherein said conduit is flexible, said conduit bend angle being variable;

a support means being comprised of a first support bracket at said proximal end, and a second support bracket at said distal end, wherein said support means is further comprised of a first plurality of support arms connected above said second support bracket and to a top side of said second support bracket, and a second plurality of support arms connected below said second support bracket and to a bottom side of said second support bracket; and means for pressurizing said conduit from said proximal end to said distal end, wherein said conduit is pressurized, and wherein the means for pressurizing comprises:

a pressure hose in fluid connection to said conduit at said proximal end.

* * * * *